United States Patent [19]

Hall

[11] 4,410,413

[45] Oct. 18, 1983

[54] CATHODE FOR ELECTROLYTIC PRODUCTION OF HYDROGEN

[75] Inventor: Dale E. Hall, Monroe, N.Y.

[73] Assignee: MPD Technology Corporation, Wyckoff, N.J.

[21] Appl. No.: 308,520

[22] Filed: Oct. 5, 1981

[51] Int. Cl.[3] ..... C25B 11/04; C25B 11/02

[52] U.S. Cl. ..... 204/290 R; 204/291

[58] Field of Search ..... 204/290 R, 291

[56] References Cited

U.S. PATENT DOCUMENTS

| | | | |
|---|---|---|---|
| 4,049,841 | 9/1977 | Coker et al. | 427/34 |
| 4,061,555 | 12/1977 | Miyatani et al. | 204/242 |
| 4,200,515 | 4/1980 | Hall | 204/290 |
| 4,243,497 | 1/1981 | Nicolas et al. | 204/98 |
| 4,323,595 | 4/1982 | Welch et al. | 427/123 |

FOREIGN PATENT DOCUMENTS

| | | | |
|---|---|---|---|
| 9406 | 9/1979 | European Pat. Off. . | |
| 31948 | 7/1981 | European Pat. Off. . | |
| 2906927 | 8/1979 | Fed. Rep. of Germany | 204/290 R |

*Primary Examiner*—F. Edmundson

*Attorney, Agent, or Firm*—Francis J. Mulligan, Jr.; Raymond J. Kenny

[57] ABSTRACT

A cathode for use in the electrochemical production of hydrogen and process for making it which involves direct electrochemical cathodic action on a thermally produced adherent oxide on a nickel cathode surface. Examples include a nickel sheet thermally oxidized in air at 600° C. for one hour and used directly in the production of electrolytic hydrogen and an iron sheet plasma sprayed with nickel to provide a surface containing thermal oxidation product of nickel and again used directly in the electrolytic production of hydrogen.

5 Claims, 3 Drawing Figures

CATHODE FOR ELECTROLYTIC PRODUCTION OF HYDROGEN

TECHNICAL FIELD

The technical field of the present invention is cathodes for alkaline electrolysis of water. More specifically the invention is concerned with cathodes which can be used efficiently in the production of hydrogen using an electrolyte comprising a relatively concentrated solution of alkaline hydroxides, for example, potassium or sodium hydroxide.

BACKGROUND ART

Insofar as applicant is aware, the most pertinent art to the present invention is contained in U.S. Pat. No. 4,049, 841 issued to Coker et al, Sept. 20, 1977 and U.S. Pat. No. 4,243,497 issued to Nicolas et al on Jan. 6, 1981. Also pertinent are the disclosures set forth in published European Patent Application No. 009,406 published Apr. 2, 1980 naming D. E. Brown et al, inventors and the Hall et al U.S. Pat. No. 4,200,515 of Apr. 29, 1980.

Coker et al described cathodes for the production of hydrogen in aqueous chlor-alkali membrane electrolytic cells which are made by either flame spraying or plasma spraying a powder metal onto a cathode base surface. The cathode base surface is advantageously ferrous metal, such as steel, and the metal of the powder which is coated is one having a lower hydrogen overpotential than the ferrous metal of the base of the cathode. Coker et al specifically include nickel as one metal which can be used effectively in the Coker et al invention. Even more pertinent, Coker et al disclosed specific examples wherein two grades of METCO TM nickel powder are used as the powder which is plasma sprayed on a steel cathode. Nicolas et al describe cathodes for the electrolytic production of hydrogen which have an active surface consisting of oxide compounds of the spinel type. Applicant has now discovered that the useful results as disclosed by Coker et al can now be substantially improved while retaining the ease of manufacture of cathodes provided by the plasma or flame spraying processes.

In addition, applicant has discovered that oxidic surfaces comprising oxides other than oxides of the spinel type can be usefully employed as active hydrogen liberating cathodes. Applicant has also discovered that by modifying or otherwise altering the disclosed techniques of Hall et al and Brown et al, improved cathodes can be made or, in the case of the Brown et al cathode of the same character can be made more readily or more cheaply.

SUMMARY OF THE INVENTION

The present invention is concerned with a cathode, particularly suitable for use for the electrochemical generation of hydrogen at a low overpotential at the interface of said cathode and an aqueous alkaline electrolyte. The cathode comprises an electrode of nickel or nickel alloy of suitable character and configuration of production of hydrogen having on the surface thereof a structure resulting from direct electrochemical cathodic action on an adherent oxide produced by thermal oxidation of said metal. Advantageously, the cathode also comprises a base and a coating of thermally integrated nickel or nickel alloy powder adhered to the base, the coating having on the surface thereof a structure resulting from direct cathodic action on a non-spinel type adherent oxide produced by thermal oxidation of the coating. In order for the cathode of the present invention to be particularly advantageous, it is necessary that this structure induced by cathodic action be present in terms of percentage of surface area (as compared to exposed, non-thermally oxidized metal) in a minimum amount. Because of the difficulty in mathematically defining this amount, the minimum amount of particular structure is defined in this specification and claims with respect to FIG. 3 of the drawing, as described hereinafter.

The base of the cathode of the present invention is for all practical purposes any base which has been contemplated in the art. It can be a simple sheet of steel or a complex of woven wire, assembled tube or the like. Chemically, the base can be of iron, carbon steel, nickel-iron alloy, nickel, ferritic or austenitic stainless steel or any other suitable metal. Advantageously, because of cost, ease of formability and availability, mild steel i.e., unalloyed steel containing less than about 0.2% carbon, is deemed advantageous for the base of the cathode.

The coating of nickel or nickel alloy powder adhered to the base has been described hereinbefore as being thermally integrated. As used in this specification and claims, the term "thermally integrated" includes nickel or nickel alloy powder which has been integrated into a unit and adhered to a base either by the process of flame spraying or plasma spraying or any process wherein metal powder can be placed on a metallic base and metallurgically bonded to the base without entirely losing the identity of the powder. One particular means of providing a thermally integrated nickel or nickel alloy powder coating adhered to a steel base is disclosed in the aforementioned U.S. Pat. No. 4,200,515 issued Apr. 29, 1980 to Hall and Huston. In this patent, the disclosures of which are incorporated herein by reference, it is taught that nickel powder can be sintered as a coating on a steel surface by heating at temperatures within the range of 750° C. to about 1000° C. in a reducing or protective atmosphere. Such a sintering process, using pure metal or metal powder associated with an appropriate binder such as an alkali silica binder or a methyl cellulose binder, is a process which will provide a thermally integrated nickel or nickel alloy powder coating within the meaning of that term as used in the present specification and claims. Other convenient means by which powder metal layers suitable for sintering can be placed on a metallic substrate are electrostatic powder coating, mechanical doctoring and the like. For ordinary purposes, the thickness of the thermally integrated nickel powder coating used in the present invention is approximately, 25 to about 400 micrometers.

The particular structure of the present cathode found to give highly enhanced results is itself the result of ordinary cathodic action in which hydrogen is evolved advantageously from an alkaline media on an oxide surface produced by thermal oxidation. The present invention was made when, in the course of research, the cathode structures of Coker et al were duplicated along with a similar structure made by plasma spraying INCO TM type nickel 123 powder (hereinafter referred to as nickel 123 powder). Nickel 123 powder is a product of Inco Ltd. made by thermal decomposition of nickel carbonyl, the manufacture of which is generally described in one or more of Canadian Pat. No. 921,263; United Kingdom Pat. No. 1,062,580 and United Kingdom Pat. No. 741,943. This nickel powder has extremely small individual particles with spiky protrusions on the individual powder particles. Upon examining, in cross section, plasma-sprayed coatings made with nickel powders employed by Coker et al as compared to coatings made with 123 nickel powder, it was found that significantly more oxide inclusions and surfaces adapted to be exposed to electrolyte were produced using the 123 nickel powder. From a commercially acceptable standpoint for usual metal coating applications, the plasma-sprayed coatings made with METCO TM nickel powder were satisfactory as plasma-sprayed metal coatings whereas the coatings made with 123 nickel powder were not. Upon testing these three coatings as cathodes in aqueous potassium hydroxide solution under hydrogen evolution conditions, it was found that the plasma-sprayed coating made with 123 nickel powder was markedly superior to the coatings made with METCO TM powder by a degree which was not explainable by apparent increased surface area of the cathode made with 123 nickel powder. Upon further investigation it is now believed that the marked superiority of the plasma-sprayed nickel 123 powder coating as a hydrogen evolution cathode is due to a structure resulting from cathodic action in an aqueous alkaline electrolyte on nickel oxide surface areas on the sprayed surface. Samples of sintered nickel coated cathode base were thermally oxidized. Thereafter these samples exhibited significantly superior electrolytic hydrogen evolution activity as opposed to unoxidized samples. It is important to note that contrary to the teachings of Brown et al, the coated and oxidized substrates of the present invention should not be thermally reduced prior to use as cathodes. Thermal reduction in hydrogen and other reducing atmospheres has been found to eliminate or greatly reduce the improvement provided by the present invention.

Metals which may be suitable for use as cathode surfaces (either as the substrate surface or a high surface area coating thereon) and which can be thermally oxidized to form an adherent non-spinel oxide coating are nickel, nickel-iron alloys, nickel-cobalt, and nickel-cobalt-iron alloys containing greater than about 60% by weight of nickel and similar alloys containing nickel and one or more elements such as chromium, molybdenum, vanadium and tungsten in total amount up to about 25% by weight. It is also contemplated within the ambit of the present invention that nickel and alloys thereof can be present on the pre-cathode surface to be oxidized in very high surface area form produced by coating a cathode base with an aluminum-rich or zinc-rich alloy of the cathode active elements and leaching the aluminum, zinc and possibly phases rich in these elements from the surface coating by alkaline action prior to oxidation. In the case of such high surface area materials thermal oxidation can often take place without external heating by merely exposing leached and washed surface to air and allowing exothermic oxidation to take place.

The oxide produced by thermal oxidation in preparation of cathodes of the present invention should be relatively thin, for example, about a maximum of about 100 μm thick. In most instances such a layer can be produced by heating in air at about 600° C. for one hour. Those skilled in the art will recognize that such an oxidizing treatment can be varied in time and temperature and should be optimized for each cathode surface. In general, too high a temperature should be avoided so as to minimize the thickness of the oxide layer produced and to minimize reduction of the exposed surface area of sintered coatings.

EXAMPLES OF CARRYING OUT THE INVENTION

Cathodes Examples 1 to 6 were made, the odd numbered cathodes being in accordance with the present invention. These cathodes were operated in 30 weight percent aqueous potassium hydroxide at 80° C. for about 6 hours and final, computer corrected, hydrogen overpotential values versus current density were obtained and are reported herein in Tables I through III. Details of the construction of the cathodes precedes each Table.

EXAMPLES 1 and 2

Sheet samples of commercially pure nickel (nickel 200) were sandblasted. The samples were oxidized in air at 600° C. for one hour. Thereafter before cathodic use the second sample, Example 2, was reduced in hydrogen at 600° C. for one hour.

TABLE I

| Current Density ($mA/cm^2$) | Example 1 ($\eta_{H_2}V$) | Example 2 ($\eta_{H_2}V$) |
|---|---|---|
| 1 | 0.120 | 0.158 |
| 10 | 0.218 | 0.287 |
| 100 | 0.317 | 0.416 |
| 200 | 0.346 | 0.455 |

EXAMPLES 3 and 4

Steel sheet samples were plasma sprayed to a thickness of about 125 μm with a nickel-molybdenum alloy containing about 12% by weight molybdenum in the sprayed coating. These samples were oxidized in air at 600° C. for one hour. One sample, Example 4, was then reduced in hydrogen at 600° C. for about one hour.

TABLE II

| Current Density ($mA/cm^2$) | Example 3 ($\eta_{H_2}V$) | Example 4 ($\eta_{H_2}V$) |
|---|---|---|
| 1 | 0.080 | 0.083 |
| 10 | 0.165 | 0.214 |
| 100 | 0.249 | 0.345 |
| 200 | 0.274 | 0.384 |

EXAMPLES 5 and 6

Steel sheet samples were coated with an aqueous slurry of nickel 123 powder containing, on a dry basis, about 1.37% by weight of a lithium silicate binder. The samples were dried carefully to avoid cracking and spalling of the coating and then the coating was sintered onto the steel in a dissociated ammonia atmosphere and at 870° C. for about ten minutes. Thereafter one sample (Example 5) was oxidized at 600° C. for about one hour.

TABLE III

| Current Density ($mA/cm^2$) | Example 5 ($\eta_{H_2}V$) | Example 6 ($\eta_{H_2}V$) |
|---|---|---|
| 1 | 0.068 | 0.115 |
| 10 | 0.142 | 0.242 |
| 100 | 0.218 | 0.370 |
| 200 | 0.240 | 0.409 |

Tables I to IV show that in each instance the thermally oxidized surface subjected to cathodic action had a significantly lower hydrogen overpotential at cathode current densities of commercial interest than similar electrodes thermally oxidized and then thermally reduced prior to being subjected to cathodic action. It was observed with nickel cathodes, Examples 1 and 5 that these cathodes exhibited a precipitous reduction in hydrogen overpotential during the first hour of cathodic exposure and thereafter the hydrogen overpotential was stable.

Figure 1:
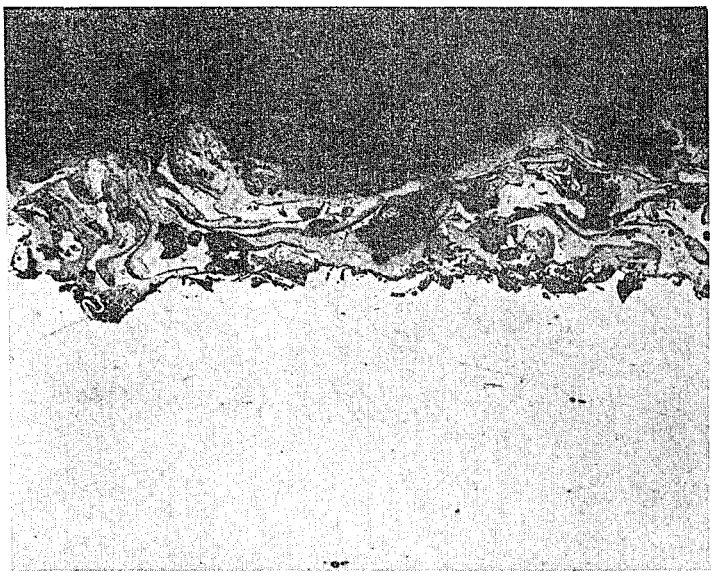
FIGS. 1 to 3 of the drawing depict respectively photomicrographical cross-sectional views of plasma-sprayed coatings of nickel on steel using 1. METCO TM nickel powder grade 56C-NS
2. METCO TM nickel powder grade 56F-NS
3. 123 nickel powder.
Figure 2:
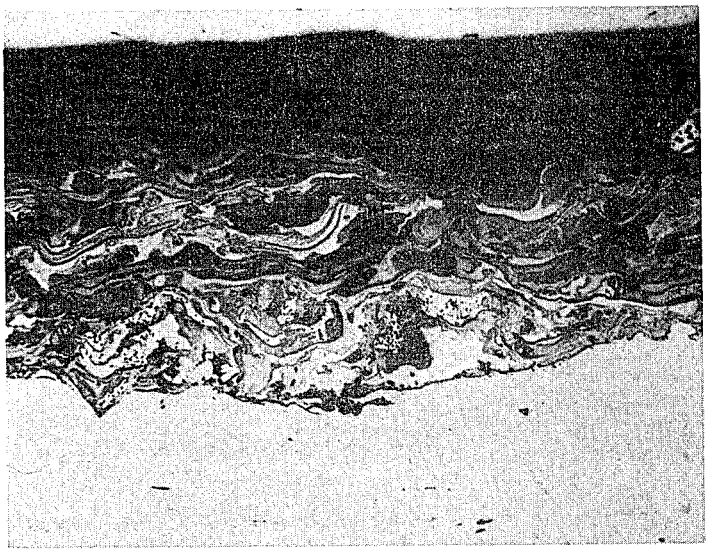
Figure 3:
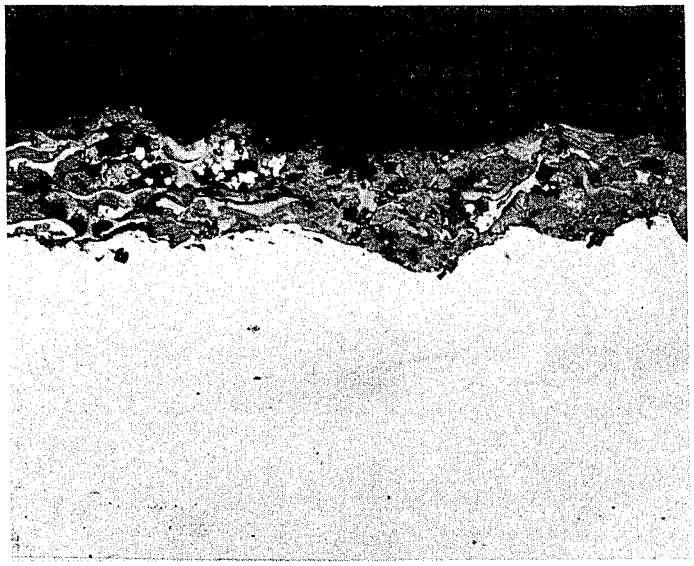

Plasma-sprayed cathodes (Examples 7 through 13) were made by spraying mild steel sheet with nickel powder. The sheet of Examples 7 and 8 was sprayed with METCO TM 56C-NS grade powder, Example 9 and 10 with METCO TM 56F-NS and Examples 11, 12 and 13 with nickel 123 powder. The sprayed sheet samples 7, 9 and 11 correspond to the cross-sections shown in FIGS. 1 to 3 of the drawing respectively. These samples represent the result of spraying a relatively coarse spherical nickel powder size range $-75+45$ μm (56C-NS or XP-1104), a finer spherical nickel powder averaging in size about 30 μm (56F-NS) and a much finer spiky nickel powder (123 nickel). FIGS. 1, 2 and 3 of the drawing show by virtue of the extent of gray areas versus white areas (black is epoxy potting material) that the sample of FIG. 3 had much more oxide (gray areas) than the samples of FIGS. 1 and 2. It is to be noted that while the surfaces of the samples of Examples 1, 3 and 5 were essentially totally covered by oxide, something less than total coverage of the nature of the coveraged depicted in FIG. 3 of the drawing will give the improved results in cathodic operation as contemplated in the present invention. Table V sets forth electrochemical results of testing the samples of Examples 9 through 13 under hydrogen evolution conditions after 6 hours in 30% by weight aqueous potassium hydroxide at 80° C.

TABLE V

| Current Density ($mA/cm^2$) | ($\eta_{H_2}V$) Examples 7 | 8 | Examples 9 | 10 | Examples 11 | 12 | 13 |
|---|---|---|---|---|---|---|---|
| 1 | 0.063 | 0.066 | 0.060 | 0.062 | 0.066 | 0.055 | 0.055 |
| 10 | 0.091 | 0.096 | 0.078 | 0.088 | 0.086 | 0.075 | 0.074 |
| 100 | 0.181 | 0.191 | 0.149 | 0.169 | 0.136 | 0.128 | 0.122 |
| 200 | 0.230 | 0.242 | 0.175 | 0.215 | 0.160 | 0.155 | 0.137 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A cathode for use in the electrolytic production of hydrogen employing an aqueous alkaline electrolyte having on at least a portion of the surface thereof a nickel or a nickel alloy from the group consisting of nickel-iron alloys, nickel-cobalt alloys, nickel-cobalt-iron alloys containing at least 60% by weight of nickel and nickel alloys containing up to 25% by weight in total of one or more chromium, molybdenum, vanadium and tungsten of suitable electrode character and configuration for production of hydrogen and including on said nickel or said nickel alloy a structure resulting from direct electrochemical cathodic action on an adherent non-spinel oxide produced by thermal oxidation of said nickel or said nickel alloy.

2. A cathode as in claim 1 which comprises a base and a thermally integrated coating of nickel or said nickel alloy on at least a portion of said base.

3. A cathode as in claim 1 wherein said structure results from direct cathodic action on an amount of surface oxide at least equal to the percentage amount depicted in FIG. 3 of the drawing.

4. A cathode as in claim 2 wherein said thermally integrated coating is a hot sprayed coated covering said base and including an amount of surface oxide at least equal to the percentage amount depicted in FIG. 3 of the drawing.

5. A cathode as in claim 2 wherein said thermally integrated coating is a coating of nickel or said nickel alloy powder sintered onto said base.

* * * * *